US005413076A

United States Patent [19]

Koenigswieser et al.

[11] Patent Number: 5,413,076

[45] Date of Patent: May 9, 1995

[54] FUEL INJECTION SYSTEM FOR INTERNAL COMBUSTION ENGINES

[75] Inventors: Rudolf Koenigswieser, Steyr; Peter Reisenbichler, Traun, both of Austria

[73] Assignee: Robert Bosch GmbH, Stuttgart, Germany

[21] Appl. No.: 225,101

[22] Filed: Apr. 8, 1994

[30] Foreign Application Priority Data

Apr. 8, 1993 [DE] Germany ..... 43 11 627.2

[51] Int. Cl.[6] ..... F02M 47/02; F02M 63/00

[52] U.S. Cl. ..... 123/446; 123/506; 239/96

[58] Field of Search ..... 123/446, 447, 456, 506; 234/93, 95, 96

[56] References Cited

U.S. PATENT DOCUMENTS

| | | | |
|---|---|---|---|
| 4,046,112 | 9/1977 | Deckard | 239/96 |
| 4,544,096 | 10/1985 | Burnett | 239/92 |
| 4,601,269 | 7/1986 | Kato et al. | 123/446 |
| 4,640,252 | 2/1987 | Nakamura et al. | 123/446 |
| 4,957,085 | 9/1990 | Sverdlin | 123/446 |
| 5,179,120 | 1/1993 | Takahashi | 123/446 |
| 5,241,935 | 9/1993 | Beck et al. | 239/96 |

FOREIGN PATENT DOCUMENTS 4115103 2/1992 Germany .

*Primary Examiner*—Henry C. Yuen
*Assistant Examiner*—Thomas N. Moulis
*Attorney, Agent, or Firm*—Edwin E. Greigg; Ronald E. Greigg

[57] ABSTRACT

The invention relates to a fuel injection system for internal combustion engines, having a high-pressure feed pump that pumps fuel from a supply tank into a high-pressure common rail that communicates with the various injection valves via high-pressure lines. To increase the injection pressure to up to 2000 bar, the injection valves have a booster piston, which is guided axially on the valve member of the injection valve and with one end face defines an injection pressure chamber that communicates with the injection ports, and with its other end face defines a work chamber that can be made to communicate with the common rail.

27 Claims, 4 Drawing Sheets

FUEL INJECTION SYSTEM FOR INTERNAL COMBUSTION ENGINES

BACKGROUND OF THE INVENTION

The invention is based on a fuel injection system for internal combustion engines as defined hereinafter. In one such fuel injection system, known from German Offenlegungsschrift 41 15 103, which serves to supply fuel to an internal combustion engine, a high-pressure fuel pump embodied as a piston pump fills a pressure reservoir chamber with fuel via a high-pressure line. From this pressure reservoir chamber, fuel injection lines lead to the individual injection valves, which communicate with one another (common rail) via the pressure reservoir chamber; the pressure reservoir is kept at a predetermined pressure by a pressure control device, so that at the injection valves the injection pressure can be fixed independently of rpm over the entire operating performance graph of the engine to be supplied.

The injection valves protruding into the combustion chamber of this engine have a pistonlike valve member, axially guided in a guide bore in the valve housing, whose one face end has a conical sealing face that cooperates with a valve seat and whose other face end defines a pressure chamber in the guide bore in the valve housing; the pressure chamber can be made to communicate with an injection pressure chamber surrounding the valve member via a connecting line containing a throttle and with a return line via a relief line containing an electric control valve. The injection pressure chamber communicates with the pressure reservoir chamber via a high-pressure fuel line and always has the same pressure level as the reservoir chamber. The valve member has a conical cross-sectional constriction in the direction of the valve sealing face in the region of the injection pressure chamber, and when the control valve is closed and there is a pressure equilibrium between the face-end pressure chamber and the injection pressure chamber, is held by its valve sealing face in contact with the valve seat by a valve spring, so that in this region the injection ports are closed.

The onset of the opening stroke of the valve member is initiated by the electrical opening of the control valve in the relief line from the face-end pressure chamber; as a result, the high pressure in the face-end pressure chamber decreases rapidly, so that a pressure drop arises between it and the injection pressure chamber; this pressure drop causes an opening stroke motion of the valve member counter to the force of the valve spring, and the throttle in the connecting line prevents a rapid return flow of fuel into the face-end pressure chamber. Analogously, the closure of the injection valve is controlled via the closure of the control valve; a high fuel pressure builds up again in the face-end pressure chamber, reinforcing the closing force of the valve spring and presses the valve member back onto its valve seat. When the control valve is without current or in other words closed, the valve member is hydraulically kept in its contact with the valve seat by the pressure in the face-end pressure chamber.

To avoid influence on the injection pressure in the filling and high-pressure chamber of the injection valve from the opening of the face-end pressure chamber, a further fuel injection system of this generic type is known from the special issue of ATZ/MTZ called Motor und Umwelt 92 [Motor and Environment 92], in which the face-end pressure chamber can be made to communicate via a three-way valve with the common pressure chamber (common rail) or a relief line. There, filling of the face-end control pressure chamber takes place unthrottled via a check valve, and the relief for opening the injection valve is throttled. The injection pressure in the injection valve is not affected in any way by the opening of the control pressure chamber, since the communication between the high-pressure line system and the face-end control pressure chamber is closed at that moment.

Both of the known fuel injection systems, however, have the disadvantage that the very high fuel injection pressure must be generated in a high-pressure fuel pump that communicates with the common pressure chamber via high-pressure lines and also communicates with the individual injection valves. The result is that in terms of strain on components and design, very stringent demands must be made of the high-pressure pump and the line system, and this dictates complicated, expensive manufacture. Furthermore, because of the relatively long transmission path from the high-pressure pump to the injection location, pressure losses arise, and so the known fuel injection systems are unable to attain very high injection pressures of up to 2000 bar. A further disadvantage of the known fuel injection systems arises from the use of the fuel, which is at high injection pressure, as a control pressure means, so that above all during closure at the end of injection, the control valves must bring to bear relatively high adjusting forces, which in turn dictates large dimensions and hence longer switching times.

OBJECT AND SUMMARY OF THE INVENTION

The fuel injection system according to the invention has the advantage over the prior art that by the use of a booster piston in the injection valve, the very high fuel injection pressure is not generated until inside the injection pressure chamber of the injection valve, so that first, the requirements for the high-pressure pump that fills the common pressure chamber and for the pressure line system can be lowered considerably, and second, very high injection pressures of up to 2000 bar can be achieved without problems. It is of special significance here that no line route is needed between the injection pressure chamber and the outlet openings of the injection valve, so that no losses from traveling over a distance ensue between the pressure generator and the injection location. It is especially advantageous for the booster piston to be disposed in a space-saving way, axially displaceably on the pistonlike valve member.

Optimal adaptation of the fuel injection system according to the invention to the requirements of the particular engine that is to be supplied can thus be achieved relatively simply, by the dimensioning of the effective end faces of the booster piston that are responsible for the transmission ratio.

A further advantage is attained by disposing a further work chamber defined by the booster piston; this first of all enables a reliable, controlled restoring motion of the booster piston without using an additional restoring spring that unevenly affects the supply stroke motion of the booster piston, and also makes possible space-saving filling of the injection pressure chamber via a conduit in the valve member.

Because the common rail pressure in the high-pressure line system is considerably less than in the known systems, it is also possible to use a relatively small electric actuator with a small moved mass as the control valve for the opening motion of the injection valve member; this actuator provides great flexibility in terms of installation and enables extremely short switching times. These short switching times are further reinforced by the very short length of the stroke of the valve member of the control valve, because only a slight cross section is required as a result of the small controlled fuel quantity in the face-end pressure chamber.

The pressure in the injection pressure chamber can advantageously be determined accurately via the outlet pressure in the common rail, and hence in the booster piston work chamber that trips the supply stroke motion, and via the transmission ratio at the booster piston.

This is further reinforced by the complete decoupling of the injection and filling processes, which is possible because of the separate fuel inlet conduits. A four-way slide valve makes it possible for the separate control of the various work chambers to be brought about advantageously with only a single high-pressure connection and a single relief connection, and the slide valve is triggered by a cam that actuates the outlet or inlet valve.

Because the instant of injection and the duration of injection are controlled by means of the control valve connected to the face-end pressure chamber, the system is easily controllable electrically and as a function of a performance graph that processes various operating parameters of the injection; because of the short switching times, both a preinjection and shaping of the injection course are also possible.

Another advantage is attained by the fact that the relief line discharges into the inlet to the high-pressure pump, while at the same time the return flow of the diverted fuel to the supply tank is prevented by a check valve; as a result, some of the energy of the diverted fuel can be used again in the high-pressure production.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
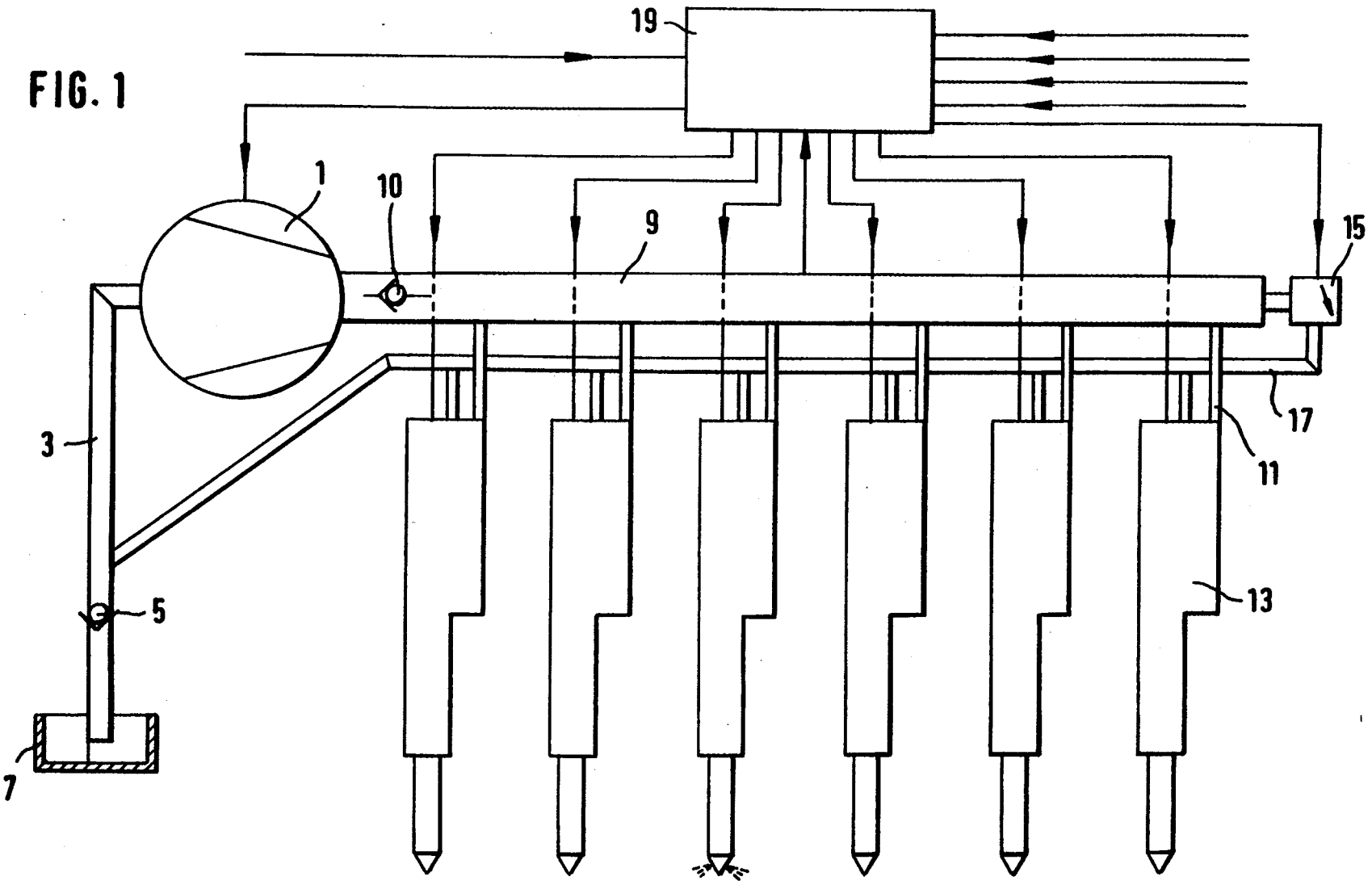
FIG. 1 shows the schematic design of the fuel injection system.

In the fuel injection system schematically shown in FIG. 1, a high-pressure fuel pump 1 communicates on the intake side with a fuel supply tank 7, via a fuel line that forms a low-pressure chamber 3 and contains a check valve 5 that opens in the direction of the high-pressure pump, and on the compression side with a high-pressure collecting chamber 9. The high-pressure collecting chamber 9 communicates via high-pressure lines 11 with injection valves 13 that protrudes into the combustion chamber of the engine to be supplied; thus the various high-pressure lines 11 communicate with one another via a common high-pressure collecting chamber 9 (common rail). Leading away from the common rail 9 in the exemplary embodiment is a relief line 17, which discharges into the low-pressure chamber 3 between the high-pressure pump 1 and the check valve 5 and which moreover communicates with the various injection valves 13 via connecting lines branching off from it. Pressure regulation in the common rail 9, in addition to regulation at the high-pressure pump 1, can be done by means of a possible pressure valve 10 between the high-pressure pump and the common rail 9; this has the advantage that the pressure in the common rail 9 is preserved after shutoff of the high-pressure pump (for improved starting performance). To enable improvement in the dynamics when the pressure in the common rail 9 drops, a pressure control valve 15 is incorporated into the relief line 17 between the common rail 9 and the connections to the various injection valves 13, and this valve in turn, like the valve 10 or a pressure-regulatable high-pressure pump 1, is triggered by an electronic control unit 19. This control unit 19 processes operating parameters, picked up from the engine to be supplied, such as the rpm, load, temperatures, pressures, and so forth as a function of performance graphs stored in memory and controls not only the pressure in the common rail 9 but also the opening times of the injection valves 13 and the high-pressure feed pump 1.

If the pressure control valve 15 should happen not to be provided, then the relief line 17 has no communication with the common rail 9.

Figure 2:
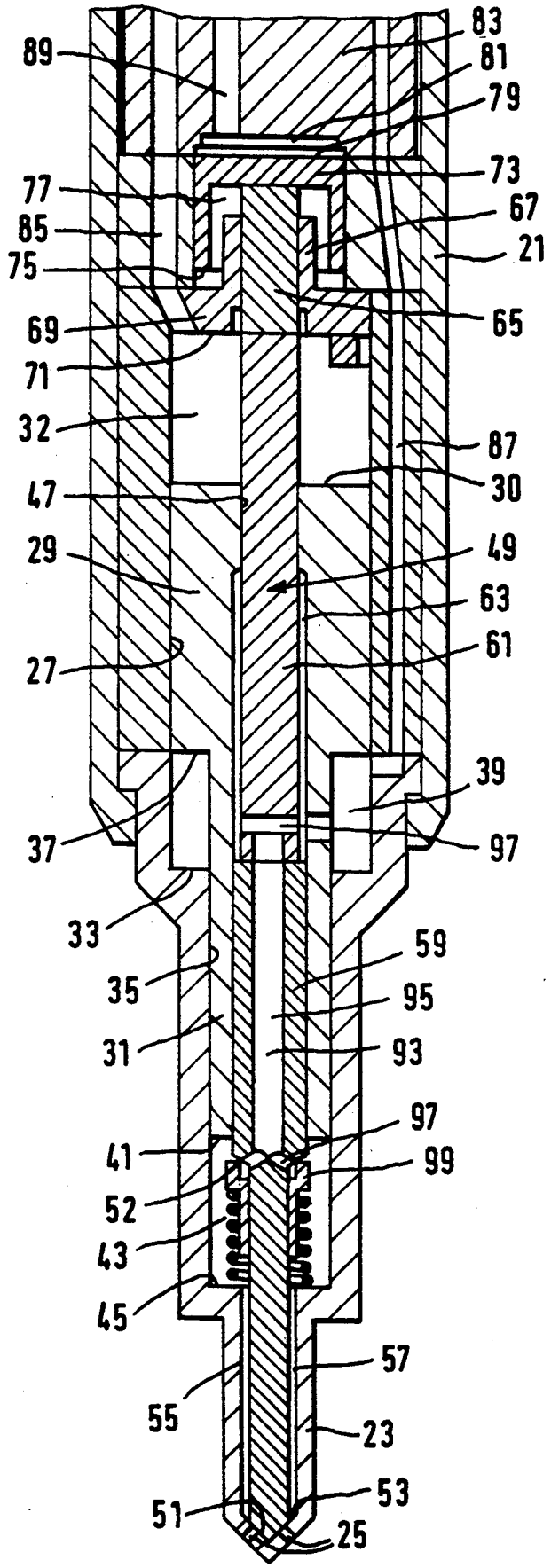
FIG. 2 is a first section through the lower part of an injection valve showing the valve member, the booster piston and the pressure chambers.
Figure 3:
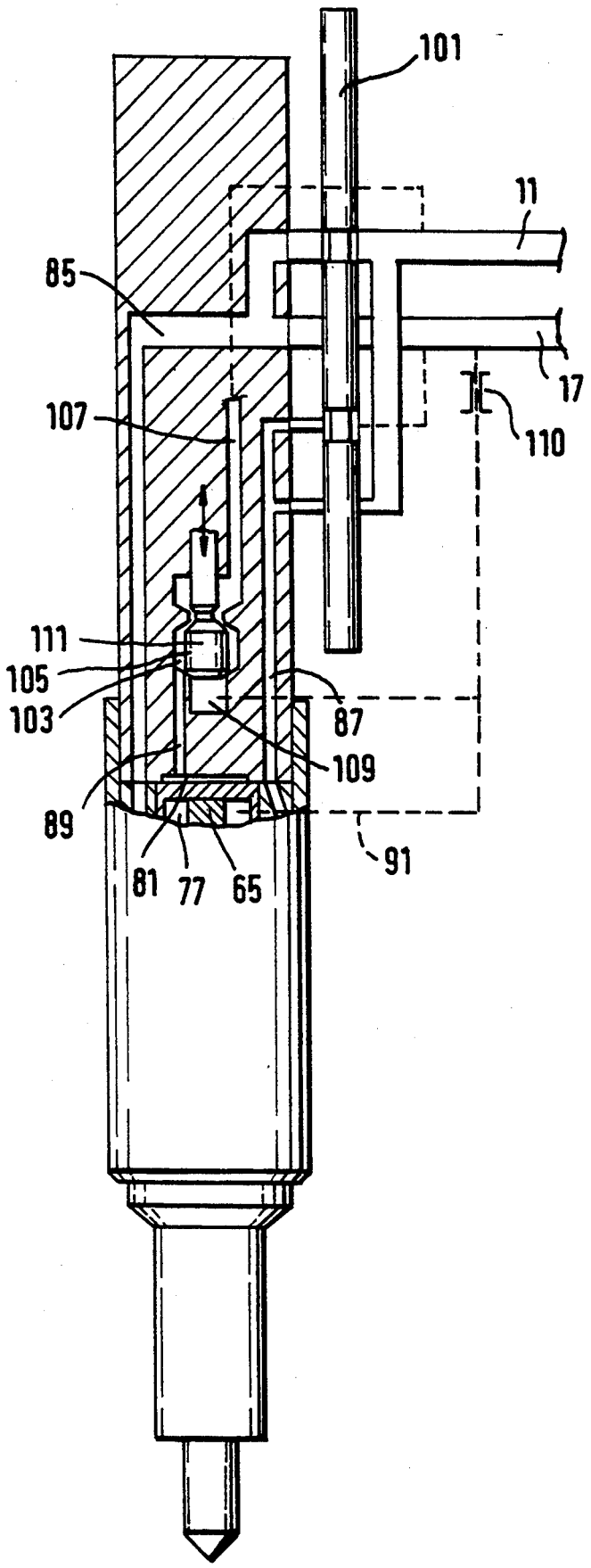
FIG. 3 is a second section through the upper part of the injection valve, in which the location and triggering of the fuel conduits is shown.

The design according to the invention of the injection valves 13 is shown in FIGS. 2 and 3; FIG. 2 is an enlarged section through the lower part, which protrudes into the combustion chamber of the engine to be supplied, while FIG. 3 is a section through the upper part of the injection valve 13.

The injection valve 13 shown in FIG. 2 comprises a multiple-piece cylindrical valve housing 21, which has a part 23 of reduced diameter protruding into the engine combustion chamber; this part has injection ports 25 on its free face end. In its interior, the injection valve 13 has a stepped bore that decreases in diameter via two steps in the direction of the injection ports 25; the first part of this bore, having the larger diameter, forms a guide bore 27, in which a larger-diameter part of a booster piston 25, embodied as a stepped piston, is axially guided; with its upper end face 30 remote from the injection ports 25, this piston defines a first work chamber 32 in the guide bore 27. In the direction of the injection ports 25, the booster piston 29 has a part 31 of reduced diameter, via a step that forms an annular shoulder 37; this part is guided in a tapered part 35 of the stepped bore that is created by a first step 33 of the stepped bore, and a further annular work chamber 39 is defined between the first step 33 and the annular shoulder 37 of the booster piston 29. The face end 41, toward the injection ports 25, of the reduced-diameter booster piston part 31 defines an annular injection pressure chamber 43, which is defined on the other side by a second step 45 of the stepped bore.

The booster piston 29 has an axial bore 47, in which a multiple-piece pistonlike injection valve member 49 is guided; on its part protruding out of the tapered booster piston part 31, this member 49 has a conical sealing face 51 on its face end, with which face, in contact with a funnellike valve seat face 53 on the closed face end of the stepped bore, it closes the injection ports 25 emerging from this valve seat face 53; in its part 55 of the smallest diameter, between the second step 45 and the injection ports 25, the stepped bore is designed such that an annular gap 57 remains between the valve member 49 and the wall of the stepped bore segment 55. In the exemplary embodiment, the injection valve member 49 is composed of four parts; a first part is formed by the so-called valve needle 59, which has a conical cross-sectional constriction 52 in the direction of the valve seat 53 and which on its face end has the valve sealing face 51, and in the closed state of the injection valve 13, or in other words upon contact with the valve seat 31, the valve needle extends into the axial bore 47 approximately as far as the region of the second work chamber 39. This needle is adjoined by a first intermediate piston 61, whose diameter is designed as slightly less than that of the valve needle 59, so that a narrow annular groove 63 remains between the wall of the axial bore 47 of the booster piston 29 and the jacket face of the first intermediate piston 61; this annular groove 63 is closed in the direction of the first work chamber 32 by a tapering of the axial bore 47. The annular groove 63 can also be made by means of a local tapering of the first intermediate piston 61. The first intermediate piston 61 is adjoined in the axial extension in the region of the first work chamber 32 by a second intermediate piston 65, which is guided in an axial bore of a tube neck 67, which in turn is inserted by a disklike top piece 69 into the guide bore 27, where with its face end 71 toward the booster piston 29 it defines the first work chamber 32.

The second intermediate piston 65 comes to rest, with its face end remote from the first work chamber 32, on the bottom of a cup-shaped piston 73, whose open side is oriented toward the tube neck 67; the piston 73 must never touch the top piece 69, so that reliable seating of the valve needle 59 on its seat and hence a secure closure of the injection valve will be assured. A further work chamber, acting as a relief chamber 77, is defined between the cup-shaped piston 73 and the tube neck 67.

With its closed face end 79, oriented toward the relief chamber 77, the piston 73 defines a further work chamber, serving as a control pressure chamber 81, which is defined on the other side by a cylindrical stopper piece 83 that closes off the stepped bore. The axial length between the face end 79 of the piston 73 and the stop face on the stopper piece 83 then determines the valve needle stroke.

For filling the various work chambers with fuel or for relieving them, fuel conduits are disposed in the injection valve; a first fuel conduit 85 discharges into the first work chamber 32, a second fuel conduit 87 into the second work chamber 39, and a third fuel conduit 89 into the control pressure chamber 81. The relief chamber 77 also communicates with the relief line 17 by means of a relief conduit 91 shown in FIG. 3.

To avoid weakening the wall of the housing of the injection valve 13, it is also possible to route the fuel conduit 87 via the first intermediate piston 61 and a further intermediate piece between the first intermediate piston 61 and the second intermediate piece 65, which further intermediate piece is then in turn axially guided again in a disklike piece between the first work chamber 32 and the top piece 69.

The injection pressure chamber 43 communicates via a connecting line 93 in the valve member 49 with the second work chamber 39, which is composed of a longitudinal bore 95 and crosswise bores 97 in the valve member that communicate with the injection pressure chamber 43, as well as a bore in the booster piston 29 that from the longitudinal bore 95 discharges into the annular groove 93 and from there leads to the work chamber 39 via an opening in the wall of the booster piston part 31. The outlet opening of the connecting line 93 in the injection pressure chamber 43 is closed by a check valve 99 that opens in the direction of the injection pressure chamber and will be described in further detail in conjunction with FIG. 4.

The triggering of the injection valve member 49 and the communication of the various fuel conduits with the high-pressure lines 11 and the relief line 17 are shown schematically in FIG. 3, in a section through the upper part of the injection valve 13.

The first fuel conduit 85 and the second fuel conduit 87 each branch to make two connecting lines, which communicate with a slide valve 101 embodied as a four-way valve and having two through openings. On the inlet side this slide valve 101 communicates with two connections each of the high-pressure line 11 and the relief line 17, which are disposed such that both the first and the second fuel conduit 85, 87 can be made to communicate with the high-pressure line 11 or the relief line 17, depending on the position of the slide valve 101.

The slide valve works with two adjusting positions; the position shown indicates the communication of the first fuel conduit 85 with the high-pressure line 11, while the second fuel conduit 87 simultaneously communicates with the relief line 17, and a second possible adjusting position enables communication of the first fuel conduit 85 with the relief line 17 and simultaneous communication of the second fuel conduit 87 with the high-pressure line 11. The slide valve 101 can be controlled by the actuating cam of charge changing valve, preferably the outlet valve of the engine, but electrical triggering as a function of engine operating parameters is also possible.

The fuel conduit 89 leading away from the face-end control pressure chamber 81 discharges into an annular valve chamber 103 of a double seat valve embodied as a three-way valve, which acts as a control valve 105, with valve seats disposed opposite one another and adjoined on the one hand by a connecting line 107 to the high-pressure line 11 and on the other by a connecting line 109 to the relief line 17. The control valve 105 has a pistonlike valve member 111, with two axially opposed conical valve sealing faces and is connected via the valve member to an electric actuator, preferably an electromagnet or a piezoelectric translator, which is triggered as a function of operating parameters by the control unit 19.

A throttle 110 inserted into the relief conduit 91 where it communicates with the relief line 17, via the connecting line 109, effects a damped relief of the control pressure chamber 81, which results in a delayed opening motion of the injection valve member 49, by way of which an injection course shaping can be performed. Filling of the control pressure chamber 81 takes place as unthrottled as possible, conversely, so as to achieve rapid closure of the injection valve member 49 at the end of injection.

Figure 4:
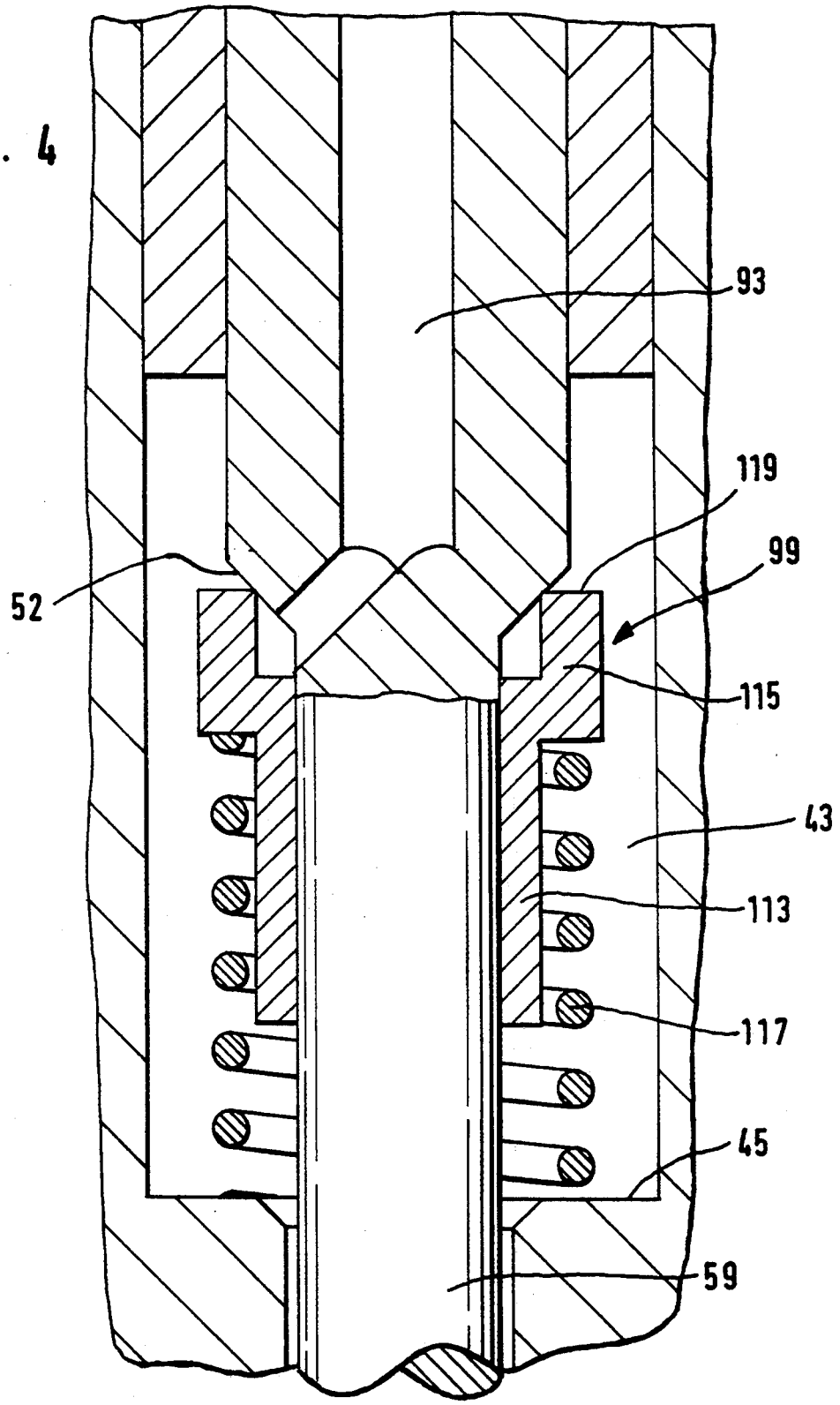
FIG. 4 shows the check valve, which closes a conduit in the injection valve member, in a section from FIG. 2.

The check valve 99, shown on a larger scale in FIG. 4 in a section from FIG. 2, comprises a tubular valve member 113, guided axially on the valve needle 59; the valve member 113 has a cup-shaped top piece 115, which is pressed by its open end face 119 against the conical cross-sectional constriction 52 of the valve needle 59 by a valve spring 117 supported on the stepped bore step 45, and which as a result keeps the outlet opening 97 of the connecting line 93 between the injection pressure chamber 43 and the work chamber 49 closed and which is opened by the transmitted pressure from the work chamber 39, which acts upon the bottom of the cup-shaped top piece 115.

The fuel injection system of the invention functions as follows:

The high-pressure fuel pump 1 pumps the fuel out of the supply tank 7 via the low-pressure chamber 3 into the common rail 9 and thus builds up the high fuel pressure there. Via the high-pressure lines 11, the fuel at high pressure flows to the injection valve 13.

There the high fuel pressure, in the compression phase shown in FIGS. 2 and 3, in which the control valve 105 connects the control pressure chamber 81 with the connecting line 107 to the high-pressure line 11, reaches the first fuel conduit 85 via the corresponding slide valve position and proceeds onward into the first work chamber 32, where it acts upon the booster piston 29 and displaces it in the direction of the injection pressure chamber 43, as a consequence of the larger effective pressure engagement surface area compared with the chambers 39 and 43. It should be noted in this respect that filling of the first work chamber 32 can alternatively be done with one separate high-pressure pump per injection valve instead.

The second piston-side work chamber 39 at this moment communicates with the relief line 17, via the second fuel conduit 87 and the slide valve 101, so that the fuel located in the work chamber 39 is positively displaced from it during the booster piston stroke motion. As a consequence of the stroke motion of the booster piston, the fuel pressure in the injection pressure chamber 43 increases to a multiple of the high pressure in the high-pressure line, and this injection pressure, which is very much higher than the pressure in the work chamber 39, keeps the check valve 99 closed.

If the fuel, which is now at high injection pressure, is to reach injection via the injection ports 25, the electrically actuated valve member 111 adjusts the control valve 105 in such a way that the fuel conduit 89 communicates with the connecting line 109 to the relief line 17, and its communication with the connecting line 107 is broken; the discharge of the connecting line 109 into the relief conduit may be effected in a throttled manner. Because of the pressure relief of the control pressure chamber 81, the hydraulic blockage of the injection valve member 49 is cancelled, and the injection pressure in the injection pressure chamber 43 lifts the valve member 49 away from its seat 53 via the cross-sectional enlargement 52, so that the fuel at high injection pressure is injected via the injection ports 25 into the combustion chamber of the engine to be supplied.

At the onset of injection, the pressure in the injection pressure chamber 43 initially drops, and as a result the booster piston 29 is pushed backward by the pressure in the work chamber 32, and in the quasi-static flow state after the acceleration phase, the injection pressure is then equivalent to that in the outset state, minus the friction loss caused by the booster piston motion. This magnitude of the pressure drop in the acceleration phase is determined essentially by the mass of the booster piston 29, which can be intentionally exploited as a parameter in the application of the system to enable a modulation at the onset of injection or to enable a preinjection.

The end of the high-pressure injection is brought about by a readjustment of the control pressure valve 105, and as a result the valve member 113 closes the communication between the control pressure chamber 81 and the connecting line 109 again and opens the communication with the connecting line 107 again. The fuel, which is at high pressure, then passes out of the high-pressure line 11 via the connecting line 107, the valve chamber 103 and the fuel conduit 89, to reach the control pressure chamber 81 and presses the valve member 49 back onto the valve seat 43 via the relatively large pressure face 79 of the piston 73.

Filling of the injection pressure chamber 43 is effected initially by the displacement of the slide valve 101, and as a result the first fuel conduit 85 and also the first work chamber 32 now communicate with the relief line 17, so that the high pressure in the first work chamber drops. At the same time, the slide valve 101 connects the second fuel conduit 87 and the second work chamber 39 to the high-pressure line 11, so that a high fuel pressure builds up in the second work chamber 39. This pressure initially causes a return of the booster piston 29 to its starting position, which may be defined by a stop. Because of the return of the booster piston 29, the pressure in the injection pressure chamber 43 also decreases sharply, producing a pressure drop between it and the work chamber 39 that lifts the check valve member 113 from its seat counter to the force of the spring 117, so that the fuel flows from the work chamber 39 into the injection pressure chamber 43. This filling ends whenever a pressure equilibrium has been established between the chambers 39 and 43, and the force of the valve spring 117 is again sufficient to close the check valve 99 again. Via a displacement of the slide valve 101 again, the compression or pressure boosting phase is thereupon initiated again.

The relief chamber 77 communicates continuously with the relief line 17 via the relief conduit 91; the discharge into the relief line 17 can be effected via a throttle, in order to keep pressure surges in the system resulting from the various diversion processes away from the relief chamber 77.

The fuel injection system of the invention thus makes it possible for the very high injection pressure necessary for injection not to be generated until within the injection valve; by disposing the booster piston axially on the valve member, this pressure boost can be achieved in a space-saving way.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, having a high-pressure fuel pump (1), which pumps fuel from a low-pressure chamber (3) into a pressure-regulatable high-pressure collecting common rail (9), which communicates via high-pressure lines (11) with injection valves (13) that protrude into a combustion chamber of the engine to be supplied and that each have a pistonlike valve member (49) that cooperates with a valve seat (53), the valve member being guided by a portion of its jacket face in a bore in the valve housing and with a free end, toward the valve seat (53) that protrudes into an injection pressure chamber (43) that communicates with the high-pressure line (11), which chamber (43) is separated from a control pressure chamber (81), which can be made to communicate with the high-pressure line (11) and a relief line (17), containing a control valve (105), into the low-pressure chamber (3), the pressure of which control pressure chamber (81) acts upon the valve member (49) in the closing direction, the valve member (49) on a part that protrudes into the injection pressure chamber (43) that has a cross-sectional enlargement (52) in the direction of the control pressure chamber (81), by way of which enlargement the fuel at high pressure lifts the valve member (49) from its valve seat (53) upon a pressure relief of the control pressure chamber (81), the injection valve (13) has a booster piston (29) in the form of a stepped piston, which with an end face (30) of a larger-diameter part defines a first work chamber (32) that can be made to communicate with the high-pressure line (11) and with the end face (41) of a small-diameter part at least indirectly borders on the injection pressure chamber (43), which can be made to communicate with the high-pressure line (11) via a controlled valve.

2. The fuel injection system as defined by claim 1, in which the booster piston (29), at a transition between the larger-diameter part and the smaller-diameter part, forms an annular shoulder (37), with which the booster piston encloses a second work chamber (39) in a stepped bore (27), which chamber can be made to communicate, in alternation with the first work chamber (32), with either the high-pressure line (11) or the relief line (17).

3. The fuel injection system as defined by claim 1, in which the communication of the high-pressure line (11) with the injection pressure chamber (43) extends via the second work chamber (39).

4. The fuel injection system as defined by claim 2, in which the communication of the high-pressure line (11) with the injection pressure chamber (43) extends via the second work chamber (39).

5. The fuel injection system as defined by claim 3, in which the booster piston (29) is guided axially displaceably on the valve member (49), and a connecting conduit (93) beginning at the second work chamber (39) and leading to the injection pressure chamber (43) is formed from a longitudinal bore (95) and one at a time of a transverse bore (97) in the valve member (49) beginning at the longitudinal bore and discharging into the second work chamber (39) or into the injection pressure chamber (43), and a transverse bore in the booster piston (29), which transverse bore can be opened and closed by means of a check valve (99), axially disposed on the valve member (49), in the injection pressure chamber (43).

6. The fuel injection system as defined by claim 4, in which the booster piston (29) is guided axially displaceably on the valve member (49), and a connecting conduit (93) beginning at the second work chamber (39) and leading to the injection pressure chamber (43) is formed from a longitudinal bore (95) and one at a time of a transverse bore (97) in the valve member (49) beginning at the longitudinal bore and discharging into the second work chamber (39) or into the injection pressure chamber (43), and a transverse bore in the booster piston (29), which transverse bore can be opened and closed by means of a check valve (99), axially disposed on the valve member (49), in the injection pressure chamber (43).

7. The fuel injection system as defined by claim 5, in which the check valve (99) that closes the transverse bore (97) of the connecting conduit (93) has a tubular check valve member (113), which is sealingly displaceable on the valve member (49) and has a cup-shaped top piece (115), whose peripheral end face (119) cooperates with the jacket face of the valve member (49) in the region of the cross-sectional enlargement (52), and which top piece (115) is acted upon by a valve spring (117) supported on another end on a step (45) of the injection pressure chamber (43).

8. The fuel injection system as defined by claim 6, in which the check valve (99) that closes the transverse bore (97) of the connecting conduit (93) has a tubular check valve member (113), which is sealingly displaceable on the valve member (49) and has a cup-shaped top piece (115), whose peripheral end face (119) cooperates with the jacket face of the valve member (49) in the region of the cross-sectional enlargement (52), and which top piece (115) is acted upon by a valve spring (117) supported on another end on a step (45) of the injection pressure chamber (43).

9. The fuel injection system as defined by claim 1, in which the valve member (49) is made in multiple parts and is composed of a plurality of pistons disposed axially one after the other, of which a first piston forms a valve needle (59), which on a face end has a conical sealing face (51) that cooperates with the valve seat (53) and in its interior has the connecting conduit (93), which needle is adjoined axially by a first intermediate piston (61) and successively by a second intermediate piston (65), on the other side of which a fourth cup-shaped piston (73) acts, which with one end face (79) defines the control pressure chamber (81).

10. The fuel injection system as defined by claim 2, in which the valve member (49) is made in multiple parts and is composed of a plurality of pistons disposed axially one after the other, of which a first piston forms a valve needle (59), which on a face end has a conical sealing face (51) that cooperates with the valve seat (53) and in its interior has the connecting conduit (93), which needle is adjoined axially by a first intermediate piston (61) and successively by a second intermediate piston (65), on the other side of which a fourth cup-shaped piston (73) acts, which with one end face (79) defines the control pressure chamber (81).

11. The fuel injection system as defined by claim 3, in which the valve member (49) is made in multiple parts and is composed of a plurality of pistons disposed axially one after the other, of which a first piston forms a valve needle (59), which on a face end has a conical sealing face (51) that cooperates with the valve seat (53) and in its interior has the connecting conduit (93), which needle is adjoined axially by a first intermediate piston (61) and successively by a second intermediate piston (65), on the other side of which a fourth cup-shaped piston (73) acts, which with one end face (79) defines the control pressure chamber (81).

12. The fuel injection system as defined by claim 5, in which the valve member (49) is made in multiple parts and is composed of a plurality of pistons disposed axially one after the other, of which a first piston forms a valve needle (59), which on a face end has a conical sealing face (51) that cooperates with the valve seat (53) and in its interior has the connecting conduit (93), which needle is adjoined axially by a first intermediate piston (61) and successively by a second intermediate piston (65), on the other side of which a fourth cup-shaped piston (73) acts, which with one end face (79) defines the control pressure chamber (81).

13. The fuel injection system as defined by claim 7, in which the valve member (49) is made in multiple parts and is composed of a plurality of pistons disposed axially one after the other, of which a first piston forms a valve needle (59), which on a face end has a conical sealing face (51) that cooperates with the valve seat (53) and in its interior has the connecting conduit (93), which needle is adjoined axially by a first intermediate piston (61) and successively by a second intermediate piston (65), on the other side of which a fourth cup-shaped piston (73) acts, which with one end face (79) defines the control pressure chamber (81).

14. The fuel injection system as defined by claim 9, in which a tube neck (67) is inserted by a disklike top piece (69) into the guide bore (27), which neck has a bore that guides the second intermediate piston (65) and that with its disklike face end (71) toward the first intermediate piston (61) defines the first work chamber (32).

15. The fuel injection system as defined by claim 14, in which a relief chamber (77) that communicates with the relief line (17) is formed between the tube neck (67) and the fourth cup-shaped piston (73).

16. The fuel injection system as defined by claim 15, in which a fuel conduit (87) that discharges into the second work chamber (39) is guided via the first intermediate piston (61), and a further intermediate piece is guided between the first intermediate piston (61) and the second intermediate piston (65) and in turn is axially guided again in a disklike piece between the first work chamber (32) and the top piece (69).

17. The fuel injection system as defined by claim 1, in which the fuel conduits (85, 87) beginning at the first and second work chambers (32, 39) can each be made to communicate with the high-pressure line (11) or the relief line (17) via a four-way valve.

18. The fuel injection system as defined by claim 17, in which the four-way valve is embodied as a slide valve (101), which is triggered in synchronism with the rpm of the associated engine.

19. The fuel injection system as defined by claim 18, in which the four-way valve is triggered by a cam of the outlet or inlet valve, in such a manner that one fuel conduit communicates with the high-pressure line (11), and the other fuel conduit communicates with the relief line (17).

20. The fuel injection system as defined by claim 1, in which the control pressure chamber (81) communicates via a conduit (89) with a three-way control valve (105), from which one connecting line (107) leads to the high-pressure line (11) and one connecting line (109) leads to the relief line (17).

21. The fuel injection system as defined by claim 20, in which the relief of the control pressure chamber (81) is effected in a throttled manner, and a filling of the control pressure chamber (81) is effected unthrottled and quickly.

22. The fuel injection system as defined by claim 20, in which the control valve (105) is embodied as a double-seat valve with conical valve seats disposed axially opposite one another, at each of which one of the connecting lines (107, 109) discharges, and between which a control valve member (111) with axially oppositely disposed conical sealing faces is disposed displaceably by an electric actuator.

23. The fuel injection system as defined by claim 1, in which a pressure control valve (10) is inserted between the high-pressure pump (1) and the high-pressure common rail (9).

24. The fuel injection system as defined by claim 22, in which the electric actuator is embodied as an electromagnet.

25. The fuel injection system as defined by claim 22, in which the electric actuator is embodied as a piezoelectric translator.

26. The fuel injection system as defined by claim 1, in which the relief line (17) that communicates with the injection valves (13) communicates with the high-pressure common rail (9) via a line segment containing a pressure control valve (15).

27. The fuel injection system as defined by claim 1, in which the relief line (17) discharges into the low-pressure chamber (3) between the high-pressure feed pump (1) and a check valve (5) that demarcates the low-pressure chamber from a fuel supply tank (7).

* * * * *